United States Patent [19]

Joffe

[11] 4,127,160

[45] Nov. 28, 1978

[54] FLUSHING OF LIQUID CIRCULATION SYSTEMS

[75] Inventor: Kenneth L. Joffe, Warner Beach, South Africa

[73] Assignee: Wynn Oil Company, Fullerton, Calif.

[21] Appl. No.: 727,143

[22] Filed: Sep. 27, 1976

[30] Foreign Application Priority Data

Sep. 30, 1975 [ZA] South Africa ..... 75/6215

[51] Int. Cl.[2] ..... F28G 9/00

[52] U.S. Cl. ..... 165/1; 165/95; 134/169 A

[58] Field of Search ..... 165/95; 134/169 A, 166 R, 134/98, 95, 56 R, 22 C; 165/41, 1; 123/41.01, 198 R

[56] References Cited

U.S. PATENT DOCUMENTS

| | | | |
|---|---|---|---|
| 2,222,516 | 11/1940 | Powell et al. | 134/169 A |
| 2,632,719 | 3/1953 | Tankersley | 134/22 C |
| 2,681,657 | 6/1954 | Griffith | 134/98 |
| 2,835,234 | 5/1958 | Rasch et al. | 134/169 A |
| 3,115,145 | 12/1963 | Monteath | 134/98 X |
| 3,409,218 | 11/1968 | Moyer | 165/95 X |

*Primary Examiner*—Charles J. Myhre
*Assistant Examiner*—Margaret A. LaTulip
*Attorney, Agent, or Firm*—Cushman, Darby & Cushman

[57] ABSTRACT

The invention comprises a method and apparatus for flushing debris from a liquid circulation system such as the cooling system of a water-cooled vehicle. The apparatus includes an inlet conduit for flushing liquid, a series of branch conduits connected to points on the circulation system, a drainage conduit for used water, and a valve or series of valves settable between various positions dictating different flow paths for the flushing liquid through the conduits and the circulation system.

6 Claims, 11 Drawing Figures

12
V1
74
10
V2
V3
56
V4
V5
76
66
76
24
26
28
68
58
26
40
60
32
44
42
30
46
78
80
62
36
38
82
84
64

12
V1
74
10
V2
V3
V4
V5
26
56
76
24
66
76
28
68
58
26
40
42
32
44
30
40
46
78
80
62
36
38
82
84
64

FLUSHING OF LIQUID CIRCULATION SYSTEMS

This invention relates to the flushing of liquid circulation systems such as the cooling and heating system of a motor vehicle.

Many motor vehicles have a water circulation system comprising a radiator, engine block and heater. Many problems are caused by the accumulation of debris in the form of rust or scale or other deposits in the system which impede the flow of the water and the conduction of heat. In the engine block itself the deposits may lead to the build-up of excessive heat and consequently to undue wear or even failure of certain components. Much the same may happen if the deposits clog the radiator or the heater.

To prevent the accumulation of deposits it is known to drain and flush the water circulation system from time to time. Flushing generally takes place by opening the system at a low point to allow drainage of water and debris, and opening the system at a high point to atmosphere - usually by removing the radiator cap - and pouring water into it. This method achieves little since there is not effective circulation of the water through the engine block or heater, and the pressure of the flushing water is low. Flushing agents which tend to remove deposits from the walls of the passages making up the system are sometimes used to enhance the effectiveness.

A further complication is the presence of the customary thermostat in one of the conduits connecting the engine to the radiator. At the temperature of water for flushing supplied from the mains, the thermostat will normally be closed and will impede effective flushing. Removal of the thermostat may assist flushing, but substantially increases the laboriousness of the flushing operation.

A consequence of these difficulties is that effective flushing is seldom carried out in routine maintenance of motor vehicles and similar machines having cooling systems, and as a result much engine wear — sometimes computed at more than 50% — is caused by poor circulation of cooling water.

An object of the invention is to provide a method and apparatus for flushing a liquid circulation system which lessens or overcomes these disadvantages.

A more particular object, applicable to some embodiments of the invention, is to provide a method and apparatus for rapidly and effectively flushing the cooling system of a motor vehicle at routine intervals, for incorporation in the normal service operations.

According to the invention, a method of flushing debris from a liquid circulation system which system includes a heat-generating unit and at least one heat-dissapating unit comprises passing flushing liquid through the units in a first flow path to remove some debris, and thereafter passing flushing liquid through the units in at least one additional and different flow path to remove further debris.

Apparatus according to the invention for flushing debris from a liquid circulation system that includes a heat-generating unit and a heat-dissapating unit comprises an inlet conduit for connection to a source of flushing liquid, and at least two branch conduits for attachment to points on the system, and a drainage conduit; and valve means inter-connecting such conduits and settable between at least two positions in each of which a flow path is defined for the flushing liquid to pass through the inlet conduit and a branch conduit to leave the apparatus and, after traversing a passage in the system, re-enter the apparatus through a further branch conduit and finally leave the apparatus through the drainage conduit, the flow paths differing for different settings of the valve means.

In the case where the circulation system comprises an engine block, a radiator and a heater, one flow path may conveniently include the engine block and the heater and another path the engine block and the radiator. A third path may include the engine block and both the heater and the radiator.

The flushing liquid is preferably circulated under substantial pressure, the apparatus including a transparent window behind which flushing water passes on its way to a drain to allow visual inspection of its condition.

In the case of a motor vehicle with a water-cooled engine, the apparatus may conveniently have three branch conduits that are connected through valve means to three points: the radiator inlet, the spigot on the engine block normally connected through a hose to the inlet of the heater, and the heater inlet itself. The valves are then operated without changing the connection point of the apparatus to pass the flushing liquid in a series of sequential and different flow paths through the water circulation system. One of the connection points at a time serves for drainage. With this arrangement, setting up of the flushing apparatus is very simple. The radiator need merely be opened and connected to one branch conduit of the flushing apparatus, and only one hose, that connecting the upper part of the engine with the upper part of the heater, need be disconnected at one of its ends and connected at that end to the remaining branch conduit of the apparatus, the third branch conduit being connected to the point from which the hose was disconnected.

The valve means conveniently comprises a main valve connected between the inlet conduit and the branch conduits for connecting the inlet conduit selectively to one or more of the branch conduits, and also includes, in each of the branch conduits serving the heater inlet and the radiator inlet, a valve for opening or closing that conduit to the flow of liquid. There is no valve in the branch conduit serving the engine block. The drain conduit is bifurcated at one end into two sub-conduits, one of which is connected via a similar valve to the branch conduit serving the radiator inlet at a point downstream of the valve in that branch conduit and the other sub-conduit being connected via a similar valve to the valveless conduit serving the engine block. The branch conduits may have portions in common in certain zones.

In the drawings

Figure 1:
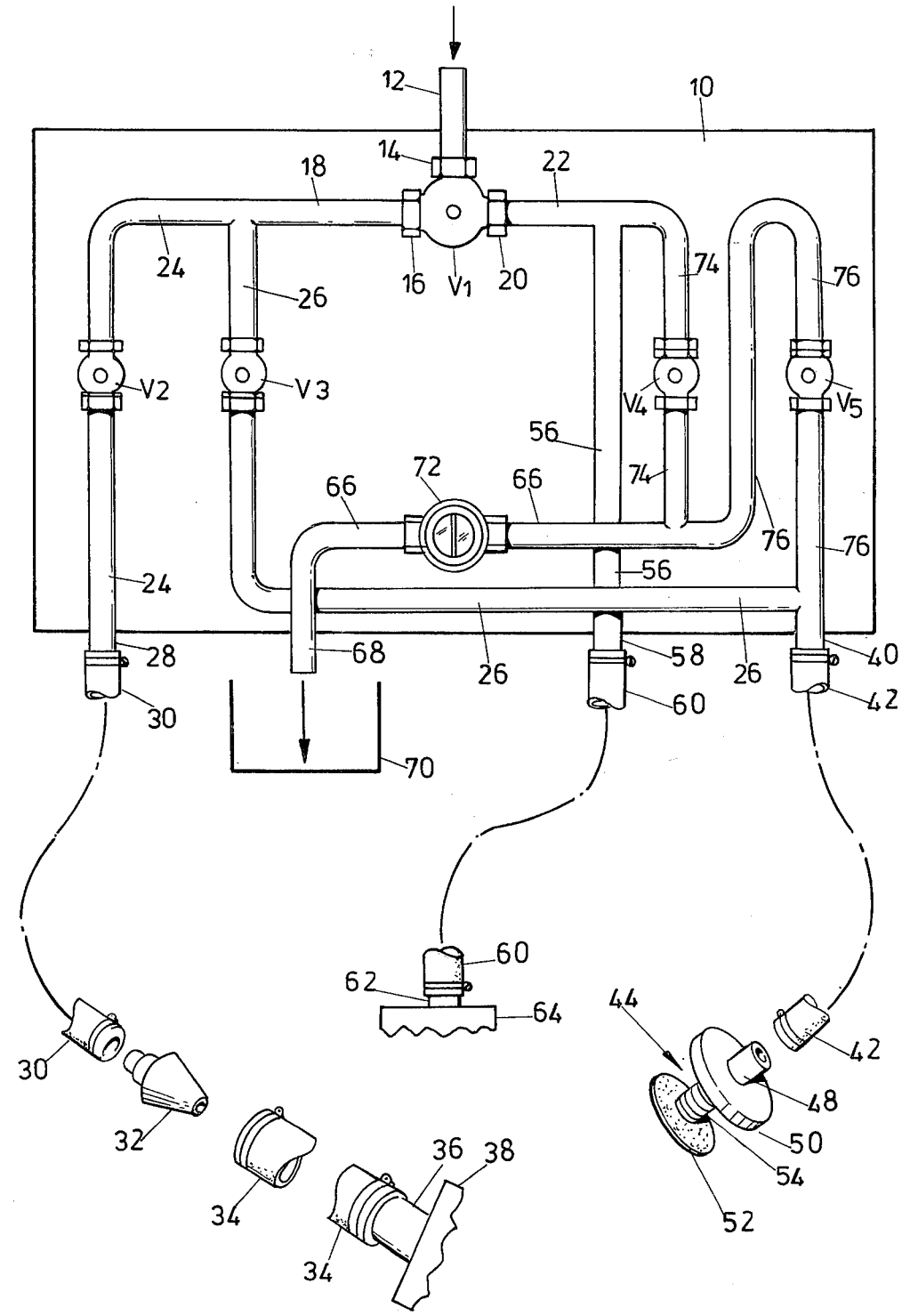
FIG. 1 is a semi-schematic view of apparatus of the invention for flushing the water circulation system of a water-cooled motor vehicle with a vertical-flow radiator.

In FIG. 1, a housing 10 (only the outline of which is shown) which may conveniently be wall-mounted in a service station is entered by an inlet or main conduit 12 adapted to be connected to a source of water under substantial pressure, normally a mains tap. The main conduit 12 ends in a three-way valve V1 having a first port 14 to which the main conduit 12 is connected, a second port 16 to which a conduit 18 is connected, and a third port 20 to which a conduit 22 is connected.

The conduit 18 divides into a first branch conduit 24 in which a stop valve V2 is located, and a second branch conduit 26 in which another stop valve V3 is located. The first branch conduit 24 has a terminal 28 outside the housing 10 connected to a hose 30 which has at its free end a conical nozzle or tip 32 (shown free from the hose 30 but in practice permanently connected to it). In use of the apparatus the nozzle 32 is inserted into and held by a clamp firmly in one end of a hose 34 whose other end is permanently connected to the upper or inlet spigot 36 of a water heater 38 of a motor vehicle. For the flushing operation, the end of the hose 34 to which the nozle 32 is connected is disconnected from the vehicle's engine block or the water pump communicating with the block.

Figure 2:
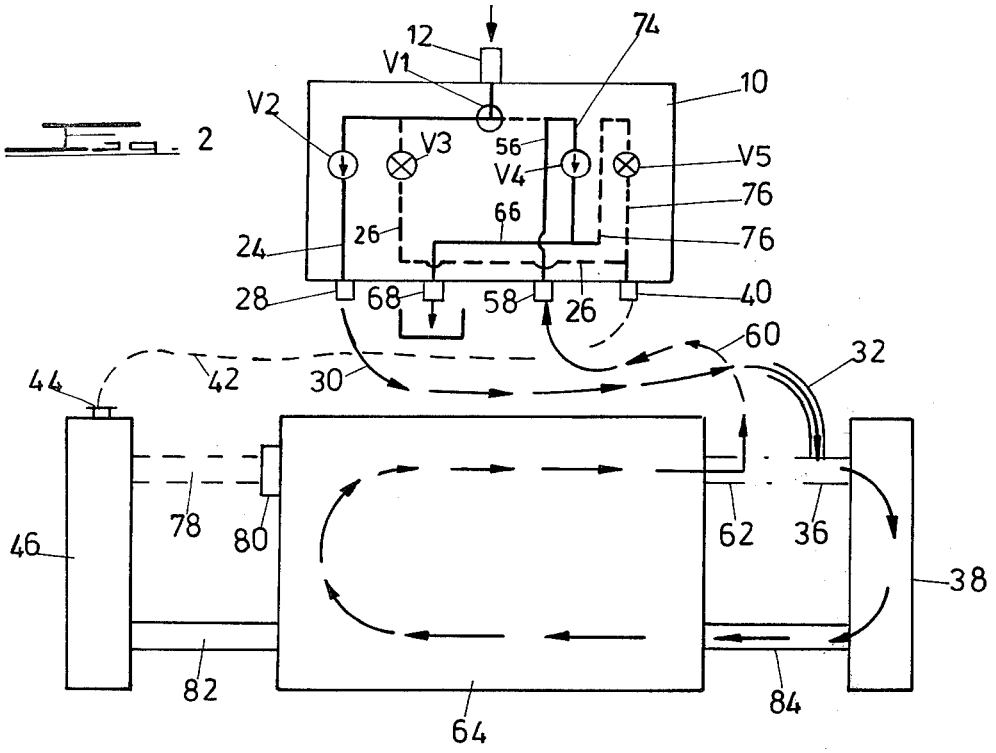
FIGS. 2–5 are semi-schematic sketches of the apparatus of FIG. 1 connected to the water circulation system of the vehicle and illustrating successive phases in a flushing operation.

The second branch conduit 26 has a terminal 40 outside the housing 10 connected by a hose 42 to a cap-like fitting 44 adapted to be fitted sealingly on to the mouth of the filler of the vehicle's radiator 46. (FIG. 2). The fitting 44 for this purpose has a tubular spigot 48 to which the hose 42 is connected and which passes with clearance through a central hole in a cover 50 which has a bayonet formation on its inner surface to clamp on the rim of the radiator filler. The lower end of the spigot 48 in FIG. 1 passes through and is sealed to an annular plate 52 which is in use forced on to the mouth of the radiator filler by a spring 54 which surrounds the tube 48 and bears upon the disc 52 and the inner annular surface of the cap 50. With this construction, water under pressure can be passed into or received from the radiator through the branch conduit 26 and its terminal 40. Note that the conduit 18 is a common part or extension of both the branch conduits 24 and 26.

The conduit 22 communicates with and forms an extension of a third branch conduit 56 which has a terminal 58 outside the housing 10. A hose 60 is connected at one end to the terminal 58, the other end being connected in use to a spigot 62 on the engine block 64, the spigot 62 normally being connected to the hose 34 and being located at a high point on the engine block and designed to supply hot water to the heater 38. There is no valve in the third branch conduit 56.

The apparatus also includes a drain conduit 66 having a terminal 68 outside the housing leading to a sump 70 for the collection of spent flushing water. A transparent window 72 is provided in the drain conduit 66, visible from outside the housing 10. It allows inspection by the operator of the condition of flushing water discharged from the apparatus. The inner end of the drain conduit 66 is bifurcated into a conduit 74 which is connected via a stop valve V4 to the conduit 22, and a second conduit 76 which is connected through a stop valve V5 to the second branch conduit 26 at a point between the valve V3 and the terminal 40.

All the valves may be of any convenient type, such as ball, gate or stop valves.

The apparatus described above is shown schematically in FIG. 2 in relation to the water circulation system of the motor vehicle. Note that there is a conduit 78 connecting the upper part of the radiator 46 to the upper part of the engine block 64, a thermostat 80 being located in this conduit. Because the apparatus will normally be used with cold flushing water, the thermostat 80 will be closed and the conduit 78 will therefore be correspondingly closed throughout the flushing operation in so far as it employs the apparatus of the invention. There is also a conduit 82 between low points on the radiator 46 and engine block 64. A similar conduit 84 is connected between low points on the engine block 64 and the heater 38.

Operation

Before the apparatus of the invention is connected to the motor vehicle, a flushing agent is introduced into the radiator and the engine is run for a suitable period to enable the flushing agent to act in stripping rust and scale deposits from the passages making up the water circulation system. The best flushing agent known to the applicant is sold under the trade name Wynn's Radiator Flush.

The apparatus is then connected up as described above and a series of flushing phases takes place in the sequence illustrated by FIGS. 2–5. In those figures the arrows and solid lines along the various conduits indicate the flow path of that phase, conduits not partaking in such flow path being shown in ghost lines.

In the first phase, shown in FIG. 2, the valve V1 is arranged so that the ports 14 and 16 (FIG. 1) are open and the port 20 is closed. The valves V2 and V4 are open (as represented by arrows) and the valves V3 and V5 are closed (as represented by crossed lines). The effect of these settings of the valves is that flushing water flows from the main conduit 12 through the main valve V1 and along the first branch conduit 24 to its terminal 28, and thence externally of the housing through the hoses 30 and 32 to enter the heater 38 at its upper port or inlet. The water passes downwards through the heater and leaves through the conduit 84 to enter the engine block 64 at a low point. It circulates upward through the engine block and leaves it through the spigot 62 to return through the hose 60 to the terminal 58 of the third branch conduit 56. It traverses this conduit and enters the conduit 74 and, after passing through the valve V4, is exhausted from the apparatus through the drain conduit 66 and terminal 68. This phase is continued until the operator notices that the water visible through the window 72 (FIG. 1) is clear.

Note that in this phase there is no flow through the second branch conduit 26 and its associated hose 42.

Figure 3:
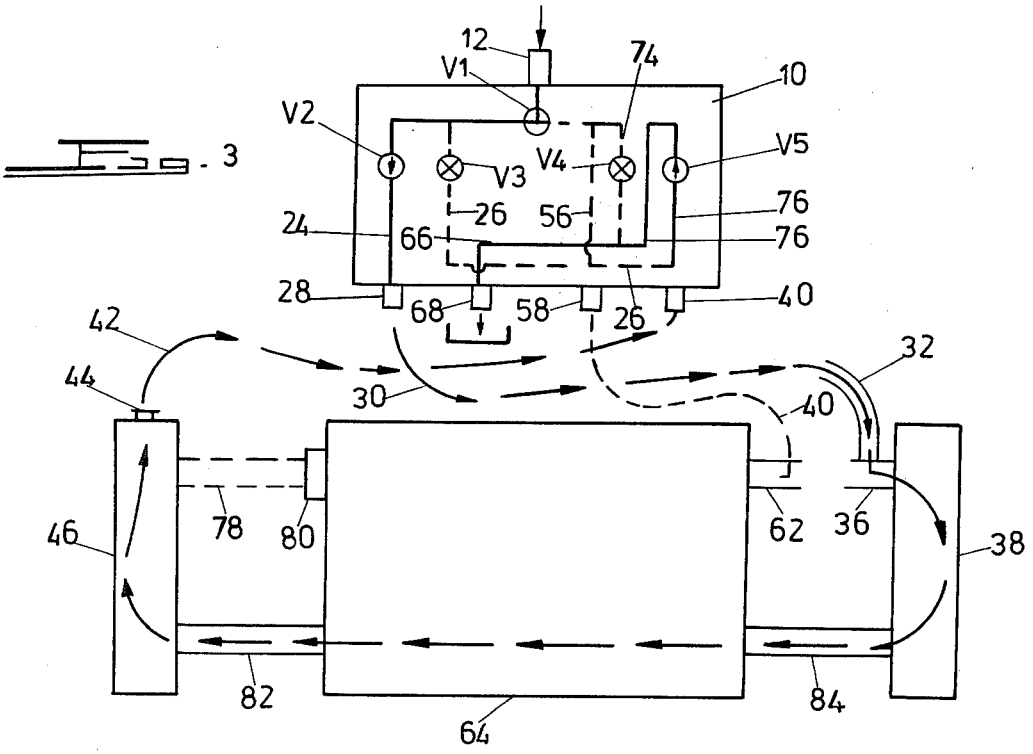

The operator then adjusts the valves to arrive at the setting of FIG. 3, in which the ports 14 and 16 (FIG. 1) of the valve V1 are again open and the port 20 closed. The valves V2 and V5 are open and V3 and V4 are closed. In this phase flow takes place through the first branch conduit 24 and the valve V2 into the hoses 30 and 32 and thus into the top of the heater 38. After leaving the heater the water passes through the conduit 84 to the engine block 64, which it traverses to enter the radiator 46 through the conduit 82 at its low point. The water rises upwards in the radiator to leave it through the fitting 44 and the hose 42 to enter the conduit 76 through the terminal 40. The water passes through the valve V5 into the drain conduit 66 and leaves the apparatus through the drain terminal 68. The second and third branch conduits 26 and 56 are in this phase excluded from the flow path, and the hose 60 correspondingly.

Figure 4:
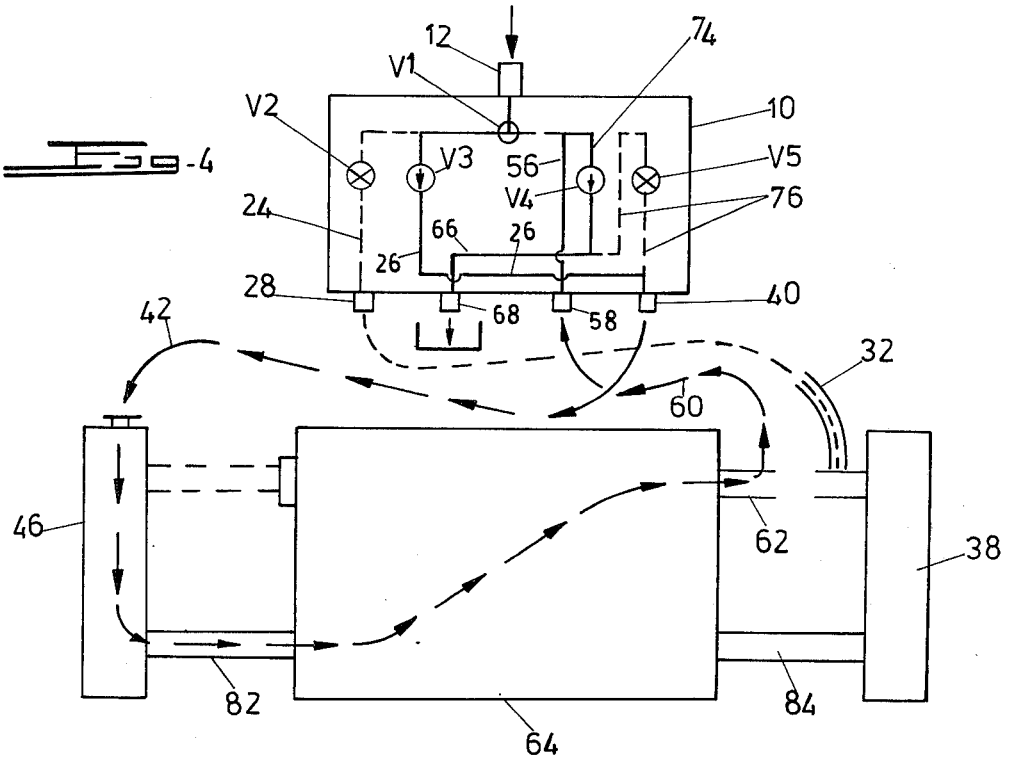

When the water visible in the window 72 again clears the operator adjusts the valves to bring about the next flushing phase, seen in FIG. 4. The valve V1 is set as in the previous two phases while the valves V2 and V5 are closed, V3 and V4 being open. Circulation takes place in this phase by a route through the second branch conduit 26 and the hose 42 into the radiator 46. The water passes down the radiator and through the conduit 82 into the engine block 64, leaving the engine block through the spigot 62 and passing through the hose 60 to the terminal 58 of the third branch conduit 56. It traverses the conduit 56 and enters the conduit 74, passes through the valve V4, and enters the drain conduit 66 to leave the apparatus through the drain terminal 68. When this flow is clear, the operator sets up the final phase, seen in FIG. 5.

Figure 5:
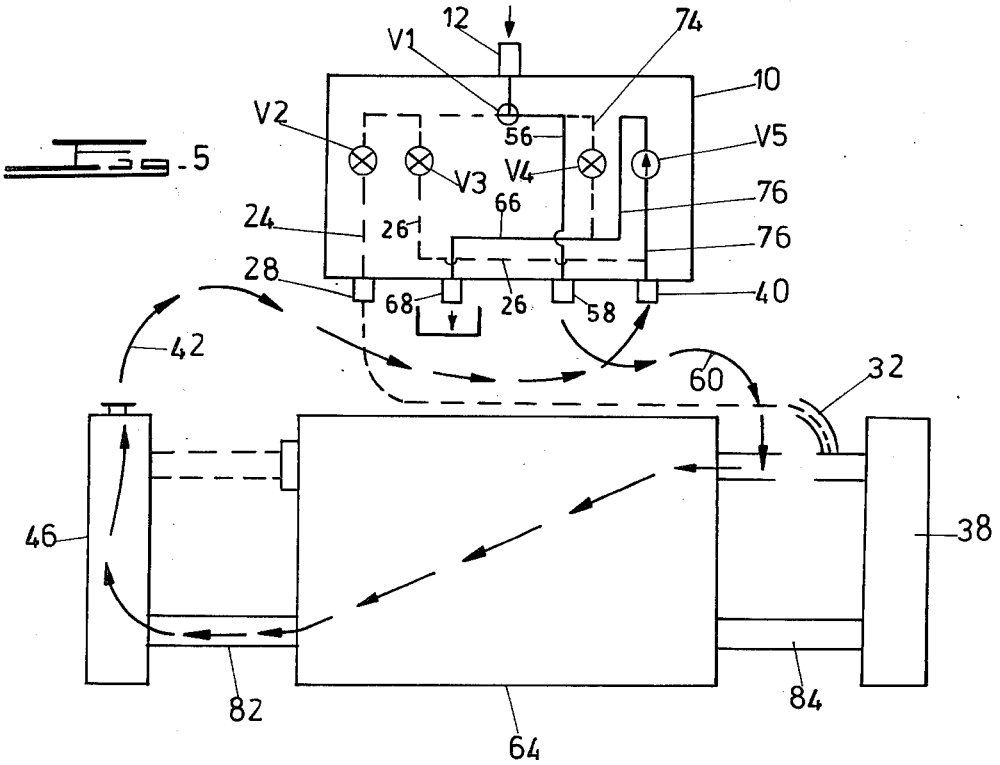

In FIG. 5, circulation takes place through the engine block and radiator in counter-flow to that of FIG. 4. For this purpose the valve V1 in FIG. 5 is set so that the port 16 (FIG. 1) is closed, and the ports 14 and 20 are open. The valves V2, V3 and V4 are closed and V5 is open. Flow takes place through the third branch conduit 56 and its terminal 58 into the hose 60 and thence into the top of the engine block 64. It leaves the engine block through the conduit 82 and moves up the radiator 46 to leave through the hose 42 and re-enter the housing 10 through the terminal 40. The water passes through the conduit 76 and valve V5 to enter the drain conduit 66 and so leave the housing thrugh the drain terminal 68.

When the flushing is over, the apparatus of the invention is disconnected and the hose 34 is reconnected to the spigot 62. A water treatment agents such as Wynn's Racing Formula for radiators is preferably added to the water with which the radiator is finally filled.

Naturally the sequence described above could take place in a different order, or some of the phases could be omitted or varied. However, a full flushing cycle such as is described above is recommended.

Since all connections are sealed, the pressure of the flushing water can be sufficiently high to free most debris likely to be encountered. There is only one set of three connections to be made to the units of the motor vehicle, so that attachment of the apparatus to the vehicle and its removal are rapid and easy to make. The remaining adjustments are made merely by setting the valves V1 to V5.

Alternative Version

An alternative version of the apparatus, suitable for largescale production, includes the valve 100 seen in FIGS. 6 to 11. This valve replaces all the valves V1 to V5 of FIGS. 1 to 5, together with some of the conduits seen in FIG. 1. The valve 100 has a body 102 on which are formed a series of spigots 104–112, corresponding to the terminals 12,58,62 and 40 of the previous embodiment.

The spigot 104 is adapted for connection to a water supply and is the inlet to the valve.

Figure 7:
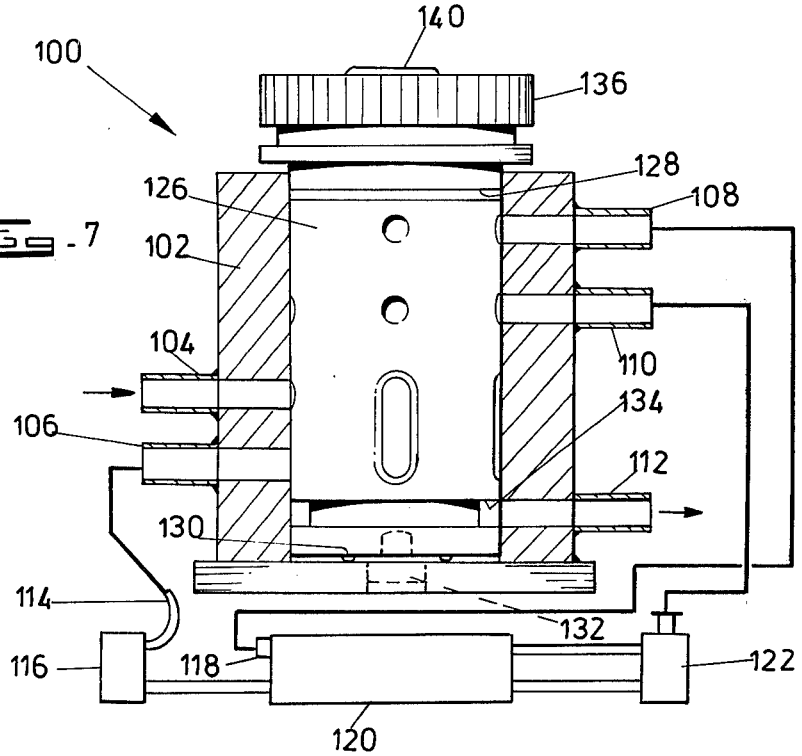
FIG. 7 is a sectioned elevation view of the valve of FIG. 6.

The connections of the spigots 106–112 are seen in FIG. 7. The spigot 106 is connected to a hose 114 at the top of a heater 116 of an internal combustion system. The spigot 108 is connected to a water pump 118 on the engine block 120. The spigot 110 is connected to the inlet of a radiator 122. The spigot 112 leads to a drain.

Figure 6:
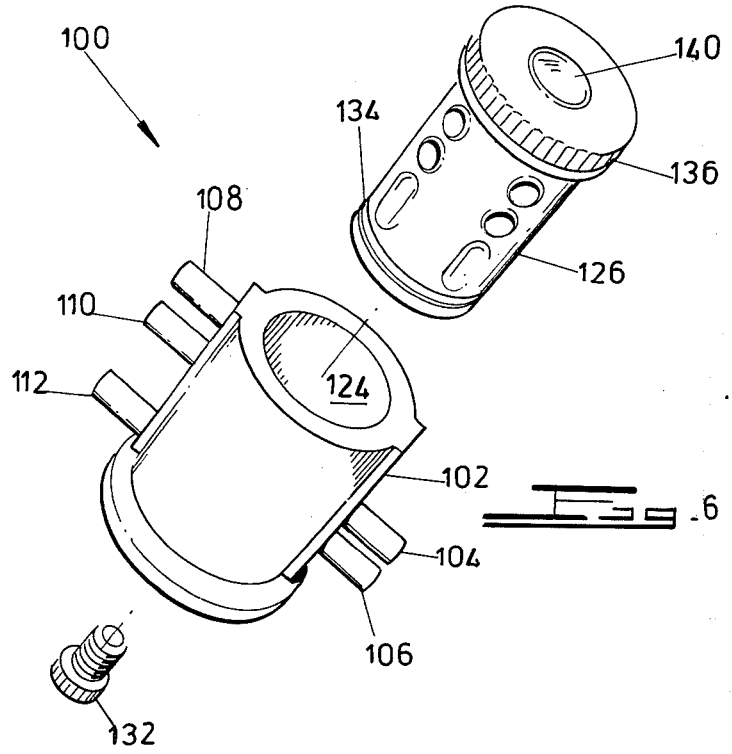
FIG. 6 is an exploded perspective view of a valve of the invention which may be used to replace some of the components in the embodiment of FIG. 1.

The body 102 of the valve 100 defines a cylindrical space 124 accommodating a cylindrical core 126 which is a rotary sliding fit in the body and which is sealed by two O-rings 128 and 130 (FIG. 7). A screw 132 with an enlarged head seats in a recess in the base of the body 102 and screws into a bore in the core 126 to hold the core against axial movement in the body 102. The core 126 is formed with a series of slots and internal passages, some of which are seen in FIGS. 6 and 7 and which are shown semi-schematically in FIGS. 8 to 11. The arrangement of the internal passages relatively to each other is a matter of choice provided they register with the spigots 102–110 in the manner to be described.

The core 126 is also formed with a peripheral groove 134 which is at all times in register with the drain spigot 112.

At its end projecting from the body 102, the core 126 has a knurled handle 136 and its adjacent end includes a sight glass 140 which is related to the internal passages in a manner to be described.

The core 126 is adapted for movement through four positions displaced at 90° from each other in the body 102. These positions correspond to the four phases of flushing described with reference to the previous embodiment, and are shown schematically in FIGS. 8 to 11.

Figure 8:
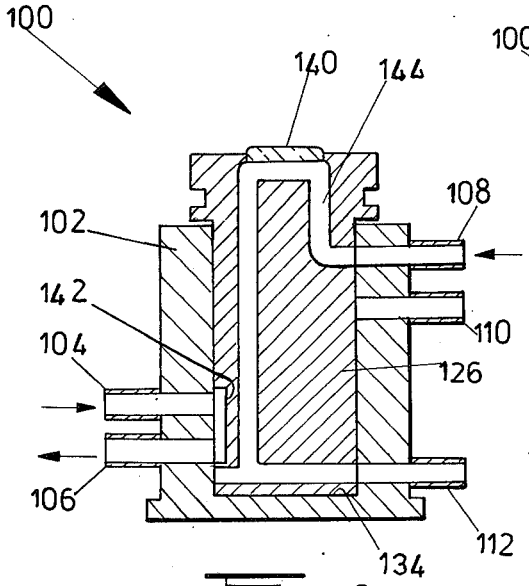
FIGS. 8 to 11 are semi-schematic sectioned view of the valve of FIGS. 6 and 7, illustrated in different positions corresponding to the phases of a flushing cycle.

The first phase of flushing, seen in FIG. 8, corresponds to the arrangement seen in FIG. 2. In FIG. 8, water entering the valve 100 through the inlet spigot 104 enters a slot 142 in the core 126 leading to the spigot 106, through which the water leaves the valve to enter the heater 116. The water circulates through the heater 116 and the engine block 120 and re-enters the valve 100 through the spigot 108. There it enters an internal passage 144 which passes past the sight glass 140 and ends in the peripheral groove 134 leading to the drain spigot 112.

Figure 9:
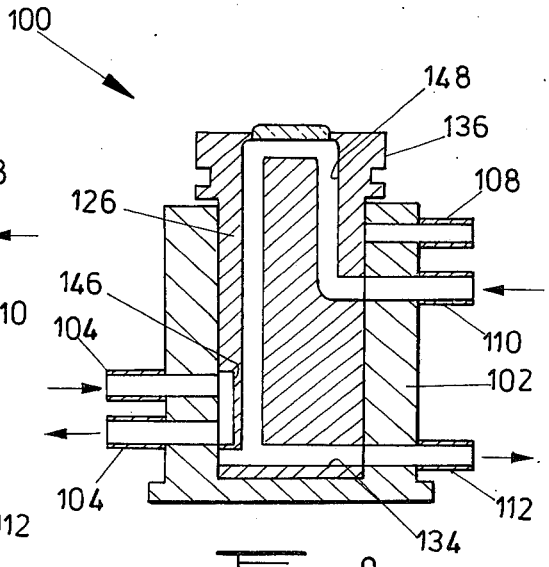

When the first phase is completed the operator moves the handle 136 through 90° to establish the setting of FIG. 9, which corresponds to the second stage of flushing illustrated in FIG. 3. In FIG. 9, water entering the valve through the spigot 104 passes through a slot 146 to the spigot 106 leading to the heater 116, and after circulating through the heater, the engine block 120 and the radiator 122, re-enters the valve 100 through the spigot 110. This spigot is in register with the end of an internal passage 148 which passes past the sight glass 140 to the groove 134 leading to the drain spigot 112.

Figure 10:
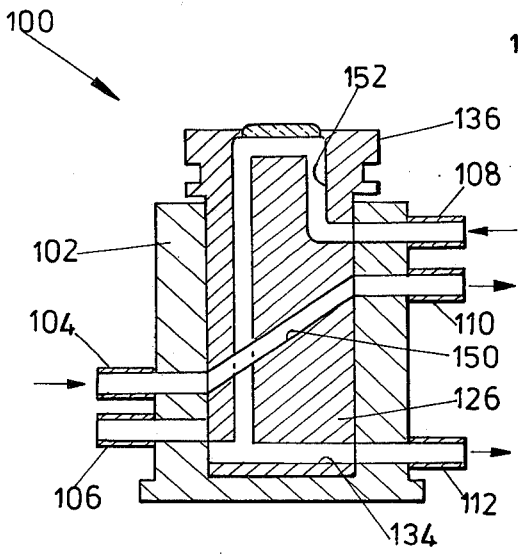

For the third phase, the operator moves the core 126 through a further 90° into the setting of FIG. 10. Water entering the valve through the inlet spigot 104 now traverses an internal passage 150 to leave the valve through the spigot 110. The water circulates through the radiator 122 and the engine block 120 in the same manner as described with reference to FIG. 4, and leaves the block 120 to re-enter the valve 100 through the spigot 108. Here it enters an internal passage 152 which takes the water past the sight glass to the groove 134 communicating with the drain spigot 112.

Figure 11:
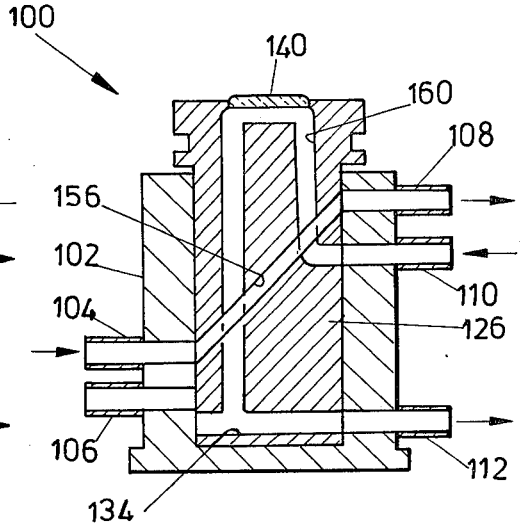

For the final phase, corresponding to FIG. 5 and seen in FIG. 11, the entering water passes through the inlet spigot 104 and an internal passage 156 to the spigot 108, whence it leaves the valve to enter the engine block 120. After traversing the block and also the radiator 122, the water re-enters the valve through the spigot 110, where it passes through an internal passage 160 past the sight glass 140 and leaves the valve through the groove 134 and drain spigot 112.

It will be obvious that the valve 100, housed in a suitable housing with the handle 136 projecting, simplifies the setting of the apparatus for the various phases.

To simplify the manufacture of the valve 100, it may if made of metal, include a relatively thin cylindrical sleeve of a plastics material between the core 126 and the wall of the chamber 124, the material being chosen for its friction properties relatively to the core and body and having openings to register with those of the spigots 104–112.

This eases the task of turning on the valve through its various settings. Suitable markings or other known means may be provided to guide the core through an arc of 90° between each setting.

In the apparatus of FIGS. 6 to 11, note that the spigot 104 acts as an inlet for liquid, the spigots 106, 108 and 110 being branch conduits which are connected selectively to the inlet and drainage conduits.

Further Alternative

It will also be obvious that, for use with a simpler form of liquid cooling circulation system for instance having only one heat-dissapating unit in addition to a heat-generating unit, the apparatus need have only two branch conduits, apart from an inlet conduit and a drain conduit, the direction of flow through the branch conduits then being reversible by actuation of the associated valve means.

We claim:

1. A method of flushing debris from a motor vehicle cooling system composed of three units in the form of a watercooled engine, a radiator, and a heater, the method including the steps of connecting each of the cooling system units by means of a conduit to a source of flushing liquid under pressure, and selectively opening and closing the three conduits and connecting one of them to a drain outlet so that flushing liquid passes in a sequence of phases through the cooling system to the drain outlet, the sequence comprising three phases in each of which the flushing liquid enters the cooling system through one of the conduits and leaves through another conduit, the flow path of the flushing liquid through the cooling system in each phase passing through at least two of the cooling system units and being different from the flow path followed in the other two phases.

2. The method of claim 1 in which during at least one of the phases the flow path passes through all three of the cooling system units.

3. The method of claim 1 in which during one phase flushing liquid enters the cooling system through the conduit connected to the radiator, and during another phase flushing liquid leaves the cooling system through that conduit.

4. The method of claim 1 in which the conduit connected to the radiator is connected to a water inlet at the top of the radiator.

5. The method of claim 1, preceded by the step of adding a flushing compound to the liquid in the cooling system and running the engine with the heater in operation to cause the flushing compound to act on all three units of the cooling system.

6. The method of claim 1 in which a thermostat located in a conduit between the engine block and the radiator is left in position throughout the flushing operation.

* * * * *